United States Patent [19]

Shields

[11] 4,232,792

[45] Nov. 11, 1980

[54] CRANE

[75] Inventor: Dean W. Shields, Orangeburg, S.C.

[73] Assignee: Kockums Industries, Inc., Talladega, Ala.

[21] Appl. No.: 879,444

[22] Filed: Feb. 21, 1978

[51] Int. Cl.[3] ..... B66C 3/00

[52] U.S. Cl. ..... 212/160; 212/195; 212/245; 212/251

[58] Field of Search ..... 212/31, 28, 35 R, 42, 212/48, 58 R, 58 A, 61, 66, 69; 104/35, 43, 46; 248/425, 429

[56] References Cited

U.S. PATENT DOCUMENTS

| | | | |
|---|---|---|---|
| 3,711,055 | 1/1973 | Schultz et al. | 104/43 X |
| 3,839,965 | 10/1974 | Frederick | 104/35 |
| 3,967,736 | 7/1976 | Tarassoli | 212/61 X |
| 4,103,783 | 8/1978 | Beduhn et al. | 212/48 |

*Primary Examiner*—Robert G. Sheridan

*Attorney, Agent, or Firm*—Newton, Hopkins & Ormsby

[57] ABSTRACT

A remotely controlled rotatable crane for loading logs on a live deck. The crane includes a carriage having a horizontal bed rotatable on a circular track about a verticle axis, the bed carrying a truss assembly extending upwardly and radially outwardly from the bed. The distal end of the truss assembly carries a vertically movable and rotatable grapple. A winch and cable raises and lowers the grapple. A counterweight is disposed on the carriage to counter balance the truss assembly. Electro-hydraulic controls operate the winch for raising and lowering the grapple, controls the rotation of the grapple about a vertical axis and its opening and closing and controls the movement of the carriage about its vertical axis. Hydraulic motors also drive wheels on the track for rotating the carriage about a vertical axis.

25 Claims, 8 Drawing Figures

CRANE

BACKGROUND OF THE INVENTION

1. Field of the Invention

This invention relates to a crane and is more particularly concerned with a crane which is rotatable about a vertical axis and is remotely controlled.

2. Description of the Prior Art

In the past, cranes have been extensively used for loading articles such as logs onto conveyors. Such cranes have also employed hydraulic systems. U.S. Pat. No. 3,967,736 granted to Iradj Tarrassoli illustrates this type of crane. The applicant is also aware of the prior art cited against the above patent. Prior art cranes or booms are not well balanced and have bending stresses in some of their parts.

SUMMARY OF THE INVENTION

Briefly described, the present invention includes a remotely controlled rotatable, generally balanced, crane for loading logs or the like onto a live deck. The crane includes a carriage member which is provided with a horizontal carriage or bed diametrically opposed portions of which extend over opposite portions of a circular track. The carriage is rotatable about the vertical axis of the track and carries a truss assembly which extends upwardly and radially outwardly from the track, the distal end of the truss assembly carrying a vertically movable and rotatable grapple.

Electro-hydraulic controls, control the operations of the carriage on the track and the operation of a winch mounted on the rear portion of the carriage for raising and lowering of the grapple. In addition, the electro-hydraulic controls, control the rotation of the grapple about its vertical axis and the opening and closing of the grapple.

DESCRIPTION OF THE PREFERRED EMBODIMENT

Figure 1:
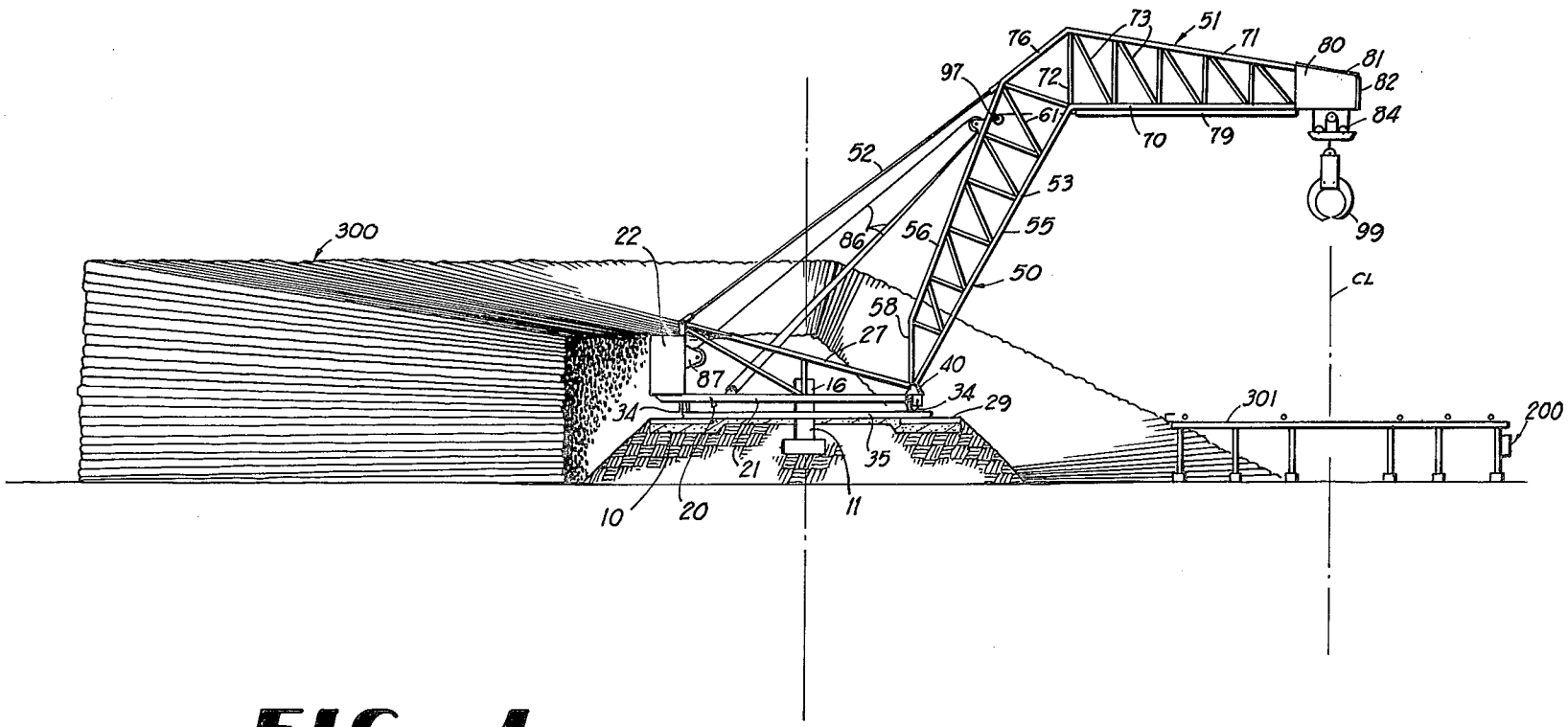
FIG. 1 is a side elevational view of a crane, constructed in accordance with the present invention, adjacent to a live deck and logs disposed about the crane.
Figure 2:
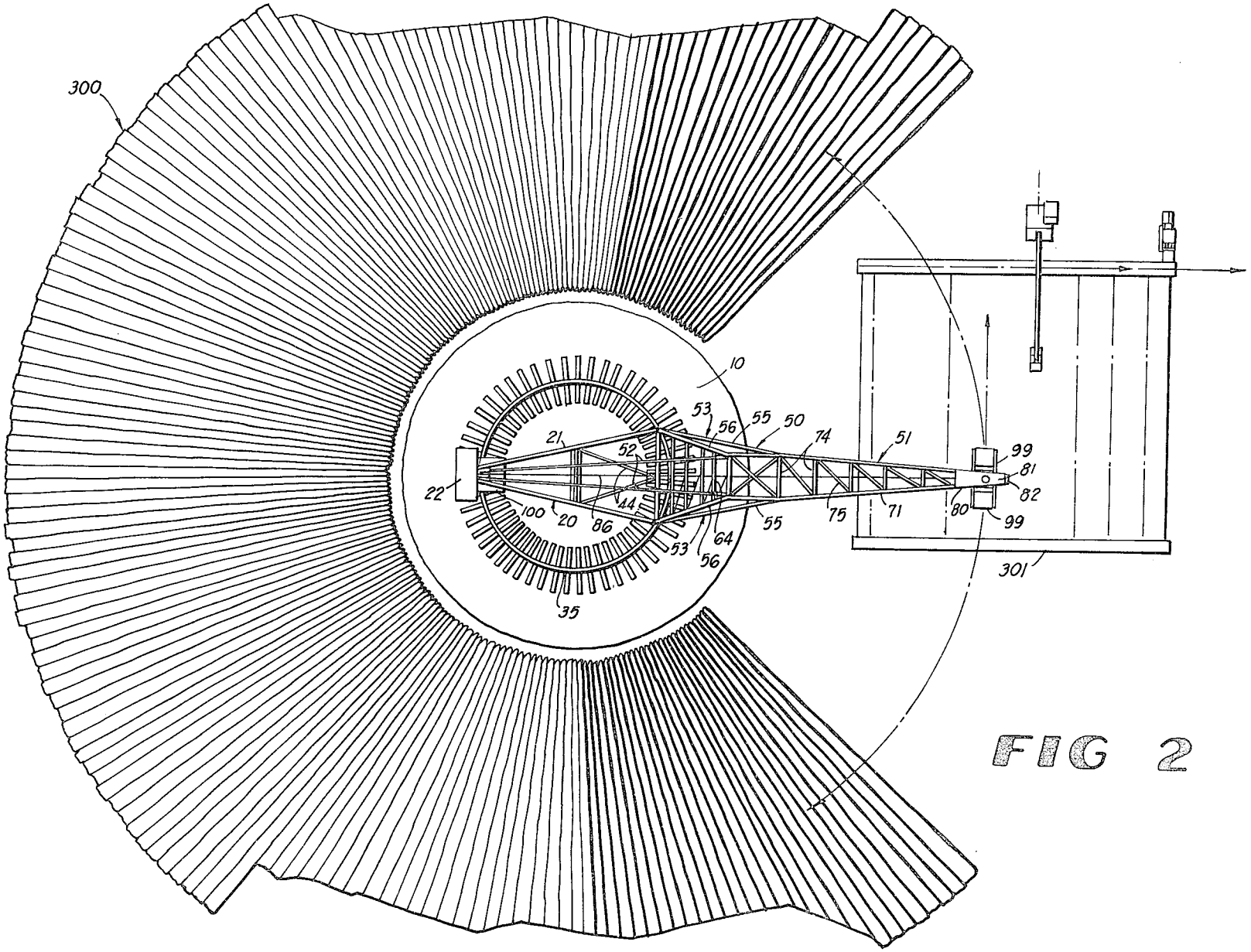
FIG. 2 is a plan view of the structure disclosed in FIG. 1.

Referring now in detail to the embodiment chosen for the purpose of illustrating the present invention, numeral 10 denotes a concrete base mounted in the ground. Within the central portion of the base 10 is embedded an upstanding, stationary, center post 11. An upstanding pivot bearing 12 is mounted on the upper end of post 11. Above and carried by the bearing 12 are the concentric, vertically spaced, slip rings 14, seen in FIG. 4A. Brushes 15 (seen in FIG. 6), slideably ride on rings 14 and are mounted in a housing 16 on a central beam 18. A journal 17 carried by central beam 18, journals the bearing 12.

Beam 18 forms the central portion of a horizontally disposed carriage, denoted generally by numeral 20. The carriage includes a pair of forwardly diverging base beams 21, the rear ends of which are secured together and carry a heavy, concrete, upstanding, right prismatic, counterweight 22. The edges of counterweight 22 are carried within an appropriate right prismatic counterweight frame 23, formed of angle irons covering the edge portions of the counterweight 22. Reinforcing struts 24 secure the frame 23 on the end portions of beams 21.

Within the counterweight frame 23 are a pair of spaced, opposed, upstanding, parallel, deflection bars 26, the lower ends of which are respectively secured to the beams 21 and the upper end portions of which are respectively connected, by means of transversely extending pivot pins 28, to the upper ends of rearwardly and upwardly extending compression braces 27 of the carriage 20.

Tension struts 30, which are embedded in the counterweight 22, converge upwardly and forwardly and terminate with their upper end portions above the counterweight and receiving pivot pins 28. The lower ends of struts 30 are secured to the lower outer corners of frame 23.

For reinforcing the carriage 30 compression struts 31 are disposed below braces 27 and extend upwardly and rearwardly from intermediate portions of the two horizontal base beams 21. The upper ends of such struts 31 also receive the pivot pins 28. Reinforcing vertical struts 32 extend between the respective beams 21 and their braces 27.

The forward ends of the base beams 21 are respectively provided with tangentially disposed corner journals blocks 33 which extend downwardly from the upper plane of the beams 21 to a position spaced below the beams 21. The function of each of blocks 33 is to house flanged track wheels 34 which ride at all times on a horizontal circular race in the form of a continuous rail or track 35 and house hydraulic motors 36 which drive the wheels 34 selectively in one direction or the other about the vertical axis of post 11. Radially disposed cross-ties 29 support the track 35, circumscribing post 11.

A horizontal disposed forward cross bar 37 joins the inner ends of the circumferentially spaced blocks 33 and gussett plates 38 extend over and reinforce these forward corner portions of the carriage 20. The gussett plates 38, each carry a pair of upstanding opposed brackets 39 which receive the spaced opposed pivot bearing 40. The axes of the two pivot bearings or pins 40 are in alignment along a horizontal axis parallel to cross bar 37. Pins or bearings 40 receive the forward ends of compression braces 27.

The length of carriage 20 is greater than the diameter of track 35 so that it overhangs the track 35 on diametrically opposite sides of the track 35.

Joining the rear end portions of base beams 21, below the deflection bars 26 is a journal block 42 (seen best in FIG. 4A). This journal block 42 carries a freely rotatable, flanged rear wheel 41 which rides on the rail 35 and provides support for the rear portion of the base 20.

The carriage or base frame 20 is quite strong in that it forms a horizontal A-frame or isosceles triangle in which the base beams 21 are the equal sides. They, in turn, are reinforced by transverse horizontal cross bar 43 extending between the rear portion of beams 21 and inner rearwardly diverging struts 44 extending from the central portion of forward cross bar 37 to the junction of the ends of the center beams 18 with beams 21. Also, the horizontal triangular construction of carriage 20 and the vertical triangular construction of beams 21, braces 27 and bars 26 in forwardly diverging planes lends rigidity to the triangular carriage 20.

The boom arm or truss assembly, as viewed from the side, is a dog-leg or L-shaped open frame member having an upwardly and outwardly inclined base section, denoted generally by numeral 50, and a horizontally disposed, outwardly extending cantilever supported, tip or boom section, denoted generally by numeral 51.

Figure 4A:
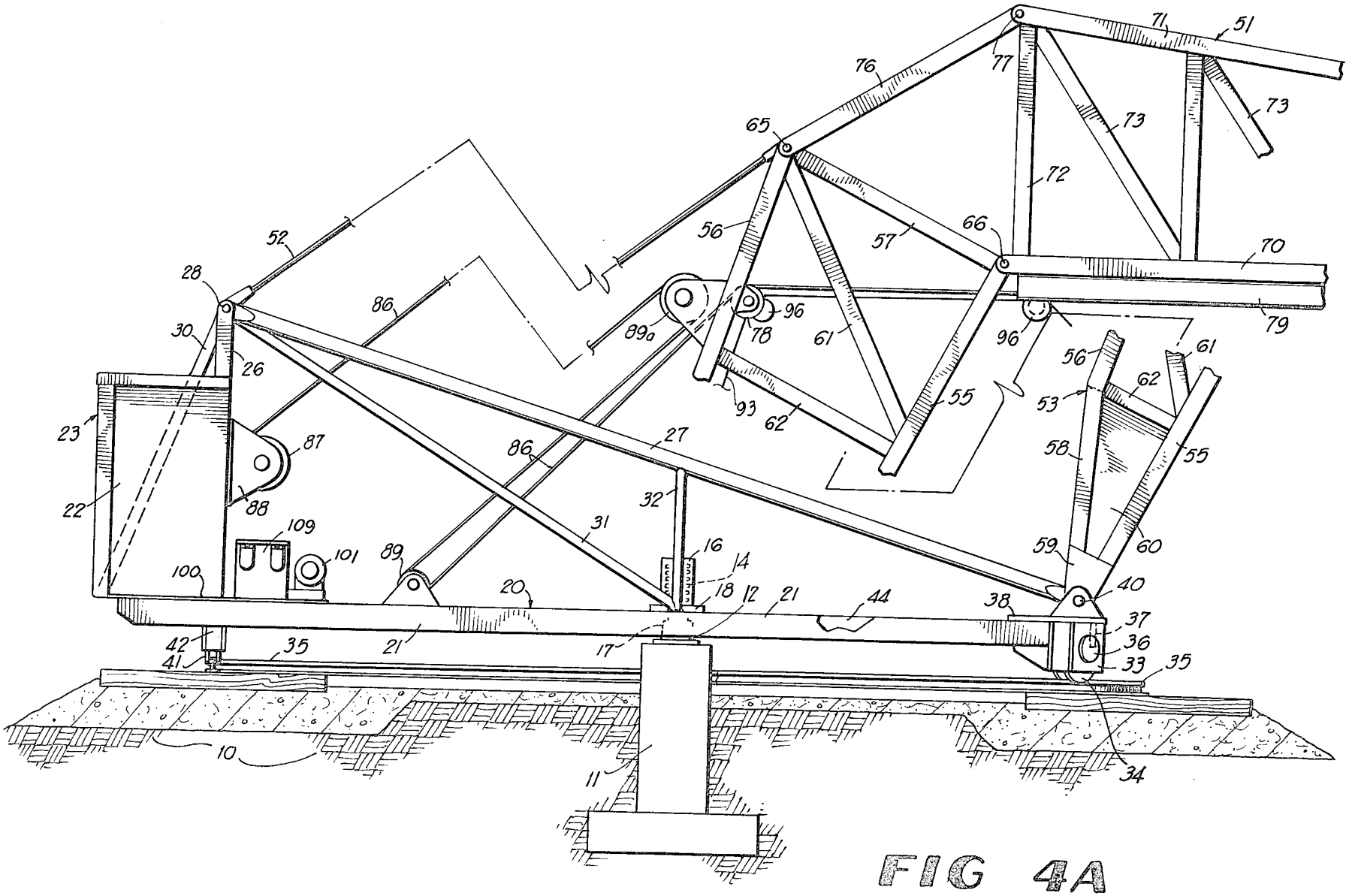
FIG. 4A is an enlarged, fragmentary, side elevational view of a portion of the crane depicted in FIG. 1.

As seen best in FIG. 4*a*, the base section 50 is pivotally supported by the pivot bearing or pins 40 so that it will pivot about a horizontal chordal axis in a radial direction. The base section 50, however, is inclined at an angle of about 60° from the horizontal and tapers upwardly and is yieldably supported in its angling position by a pair of opposed cables 52.

In more detail, the base section 50 of the truss assembly is made up of two spaced, opposed, generally triangular shaped truss legs, the apexes or lower ends of which are carried by the pins 40. The opposed truss members or legs 53 are each made up of a main beam 55 and an auxiliary beam 56 which diverge upwardly from each other, their outer ends being joined by a cross beam 57. The auxiliary beam 56 at its lower portion is joined to a stub beam 58 which is connected to the lower end of the main beam 55 by a gussett or reinforcing plate 60, in the lower end portion of the truss member, extends between beam 58 and 55. Diagonal reinforcing struts 61 and beams 62 zigzag throughout the length of each upstanding truss legs 53.

The two transversely spaced truss legs 53 taper upwardly and are joined together by spaced cross beams 64. Cables 52 are secured, to the upper ends of legs 53 by pivot pins 65. The lower ends of cables 52 are secured to pivot pins 28 so that the tension of supporting the upwardly and outwardly inclined base section 50 is transmitted, via cable 52 to the rear portion of carriage 20 and the counterweight 22.

Connected to the upper end of legs 53 by the pins 65 and 66 is the horizontal tip or boom section 51, referred to above. This tip or boom section 51 includes a pair of opposed triangular, forwardly tapering, truss members formed by lower horizontally disposed compression girters 70 and upper tension beams 71, each upper beam 71 tapering outwardly toward its associated girder 70. Upright cross bars 72 join the girter 70 and its beam 71 of each truss member, while diagonally extending struts 73 extend between the ends of adjacent cross bars 72. Transverse cross beams 74 make up the rectangular cross section of the tip section, these cross beams 74 being reinforced by diagonal struts 75. The inner end portions of the beams 71 are joined by connector beams 76 to the pivot pins 68, the ends of the beams 76 being joined to the beams 71 by pins 77.

Carried by the outer end of the tip or boom 51 section is a downwardly opening housing formed of metal plates, such as plate 80, 81 and 82 which house top sheaves 83. Cooperating bottom sheaves 84 are provided on the grapple support 85. A winch cable 86 anchored to the housing passes between sheaves 83 and sheaves 84 and thence back through a cable guide 79 to an idler sheave 78 on the upper portion of base section 50. From the idler sheave 78 the cable 86 passes downwardly, looping around an idler pulley 80 on carriage 30 and then up over idler pulley 89*a* on the upper portion of base section 50, thence to cable 86 to the take up spool 87 of a hoist winch 88. The hoist winch 86 is mounted on a plate 82 spanning the torsion bars 26. Thus, the weight carried by the cable 86 is transmitted to the counterweight 22. Support 85 carries the grapple 99.

Figures 4B, 4C:
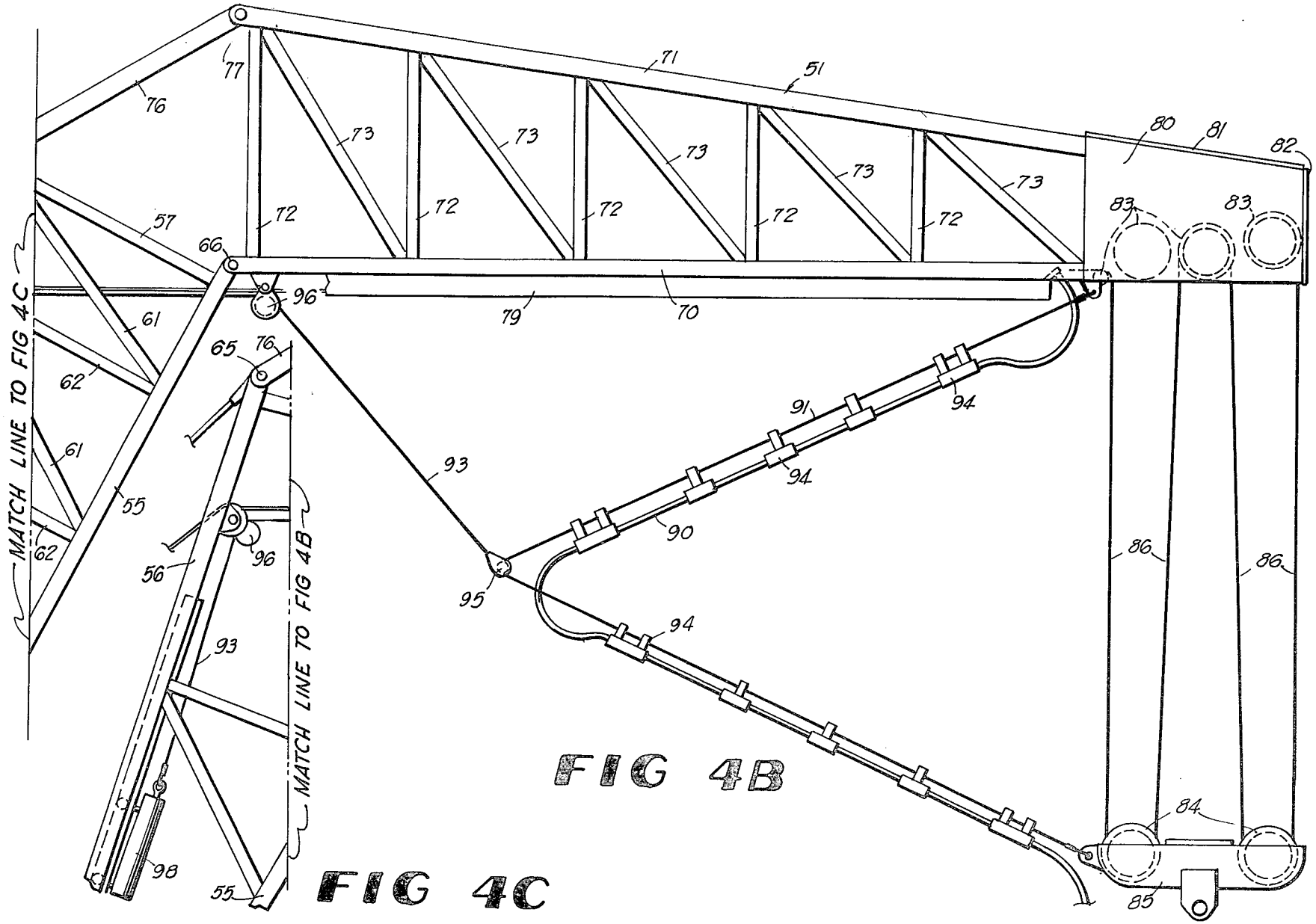
FIG. 4B is an enlarged, side elevational view of the distal portion of the crane depicted in FIG. 1.
FIG. 4C is an enlarged, side elevational view of still another portion of the crane depicted in FIG. 1.

As seen in FIG. 4B, the hydraulic lines 90 for the grapple 99 are supported by slideable couplings 94 from a safety cable 91, the cable 91 being connected at one end to the tip section 51 and at its other to support 85. A slack takeup pulley 95, carried at the end of a slack take up cable 93, receives the central portion of cable 91. Cable 93 passes over a pulley 96 on the inner portion of tip 51 and thence to a position on the crane where it receives a counterweight 98. Pulley 96 thus yieldably holds the central portion of the cable 91 laterally off-set, as shown in FIG. 4B, so that line 90 does not become entangled in cable 86.

ELECTRO-HYDRAULIC SYSTEM

Figure 3:
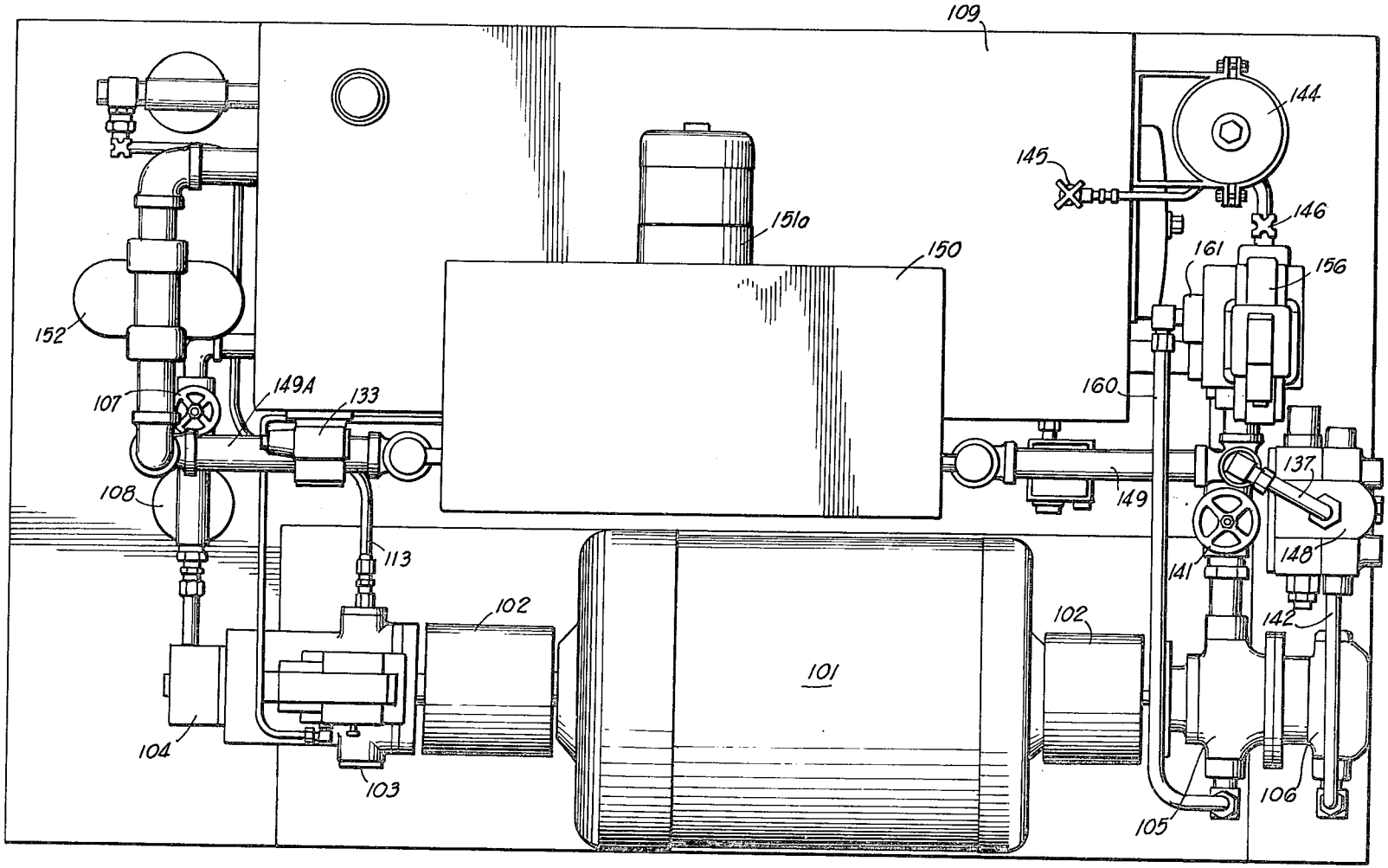
FIG. 3 is an enlarged plan view showing the hydraulic controls of the crane of FIG. 1 mounted on the carriage of the crane.
Figure 5:
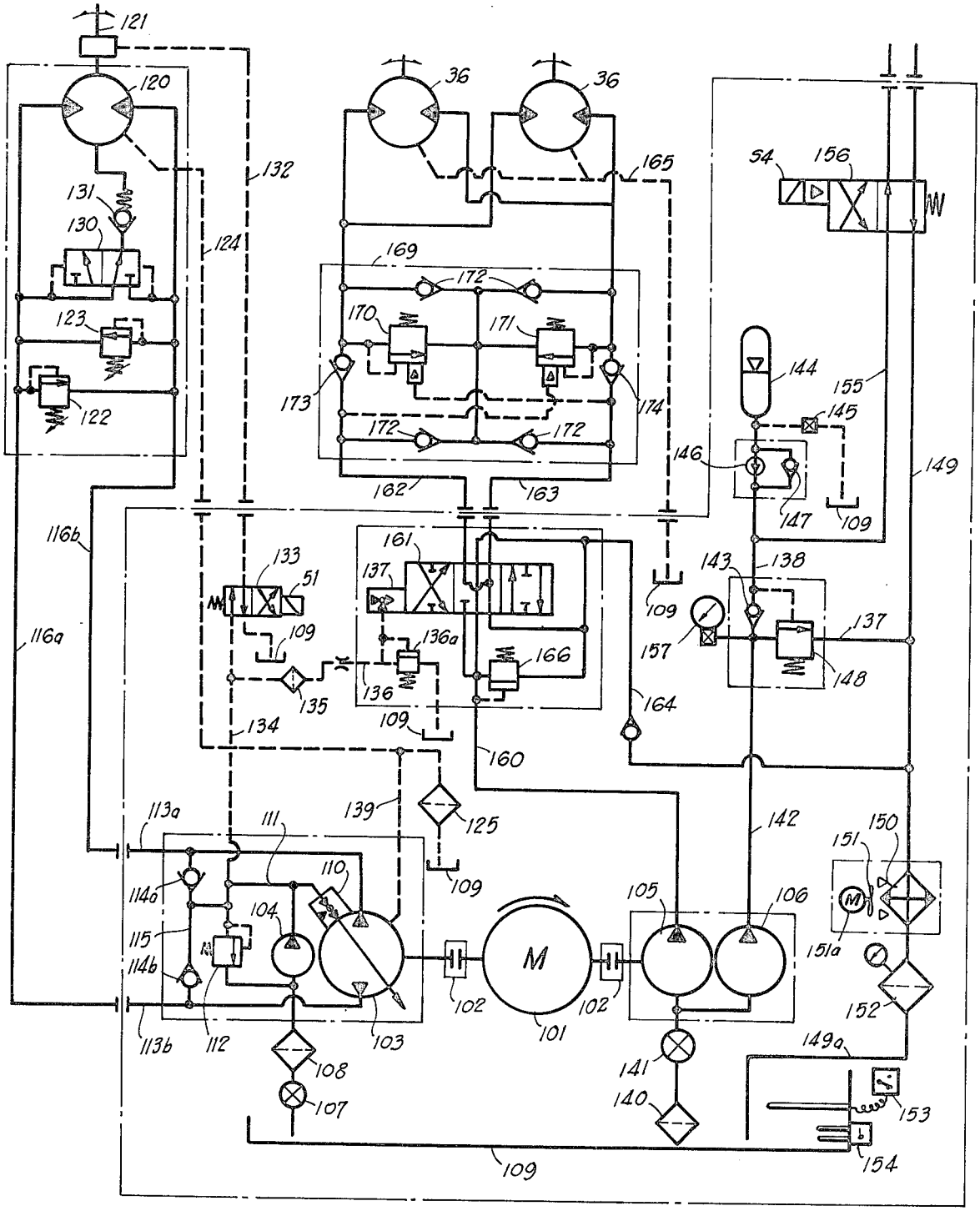
FIG. 5 is a schematic diagram showing the hydraulic system of the crane depicted in FIG. 1.
Figure 6:
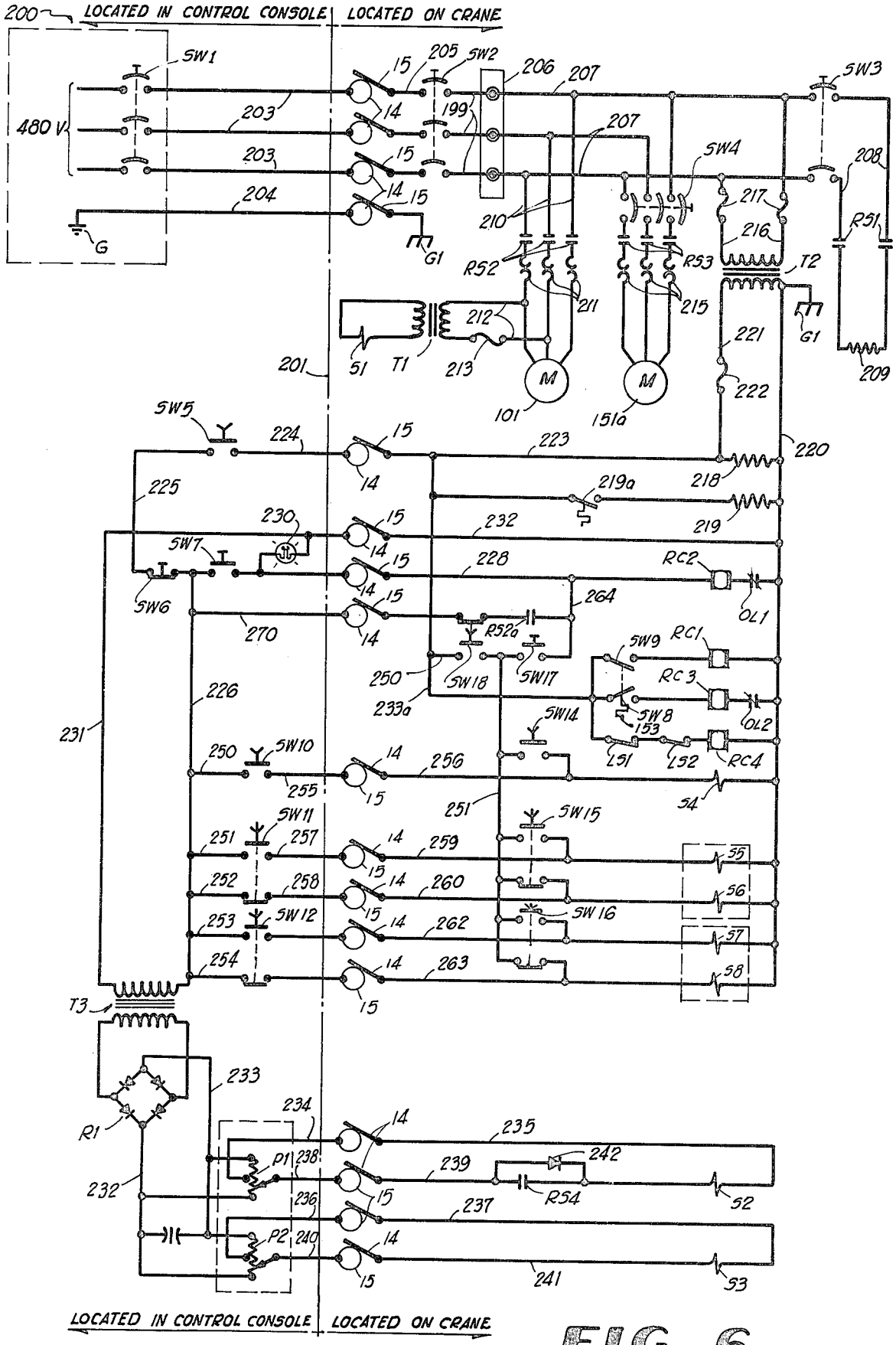
FIG. 6 is a wiring diagram of the electrical system of the crane depicted in FIG. 1.

The electro-hydraulic system for operating the crane of the present invention is illustrated in FIGS. 3, 5 and 6. The hydraulic controls themselves are mounted as shown in FIG. 3 on a system support platform 100 on bed 20 adjacent to the counterweight 22. The electrical controls of the electrical system are remote from the crane, as shown in FIG. 6, so that, the crane can be operated from a convenient remote station (not shown) which has a control console, denoted by numeral 200 in FIG. 6.

The hydraulic system as best seen in FIG. 5 includes a master electrical motor 101 which is of approximately 100 horsepower. Both ends of the shaft of the motor 101 are provided with couplings 102 which connect respectively, to a pair of pumps 103 and 104 on one side of motor 101 and pumps 105 and 106 on the other.

The pump 104 is a low pressure pump which is in series with the high pressure pump 103. The low pressure pump 104 takes a suction through manual valve 107 and filter 108 from a sump tank 109. Low pressure pump 104 supplies hydraulic fluid via a control valve 110 to the high pressure pump 103. Any excess fluid is returned to the low pressure side or the low pressure pump 104 via conduit 111 and check valve 112. The pump 104 normally supplies an excess of fluid and therefore, maintains a low positive pressure on the return side of the hydraulic line, operated by the high pressure pump 103.

The high pressure pump 103 supplies fluid selectively, via conduits 113*a* and 113*b*, the two being connected via check valves 114*a* and 114*b* to the discharge of the low pressure pump via line 115. As will be explained, hereinafter, a solenoid S2, controlled by potentiometer P1, controls whether pump 103 delivers fluid to line 113*a* or 113*b* and how much is delivered. A positive pressure however is maintained on both the high pressure lines 113*a* and 113*b*. These lines 113*a* and 113*b* lead through appropriate high pressure lines or tubing 116*a* and 116*b* to respective sides of the winch motor 120. The motor 120 is connected through a brake 121 to the winch 87. When motor 120 is driven in one direction, winch 87 takes in cable 86. When motor 120 is driven in the opposite direction, winch 87 lets out the cable 86.

Connected between the two high pressure lines 116*a* and 116*b* are a pair of relief valves 122 and 123. Thus, if too high a pressure is developed in one line, the relief valve 122 or 123 will transfer excess fluid to the other line. The winch motor 120 is provided with a return line 124 which leads back to the high pressure pump 103 and also through a filter 125 to the sump 109. The pump 103 supplies approximately 3,000 psi to the high pressure lines 116*a* and 116*b*. Thence, the high pressure is applied to both sides of the motor 120. A throttle valve 130 connected between lines 116*a* and 116*b* supply through a check valve 131 a small amount of liquid to the motor 120 and thence to the return line 124. This trickle amount of liquid is for the purpose of cooling the hydraulic system and the hydraulic lines. Cooling fluid for pump 103 is returned to the sump 109 via line 139.

When the potentiometer P1 (FIG. 4) is moved in one direction or the other, the liquid supplied to the motor 120 in greater volume via one line 116*a* or 116*b* while the other line functions as a return line. Hence, the winch motor 120 will be driven in one direction or the other direction depending upon the position of the potentiometer P1.

The brake 121 is supplied from the pump 120 with hydraulic fluid and this hydraulic fluid returns via line 132 and a brake valve 133 to the sump 109. The return line 132 is also connected through the brake valve 133 to a return line 134 and thence to the conduit 111. Whenever the motor 120 is not turning, the brake 121 is on, so that there is no chance of dropping the load.

The suction side of pump 106 is connected to sump 109 through a manual gate valve 141 and a filter 140. The discharge of pump 106 is connected via line 142, check valve 143, line 138 and flow control valve 146 to an accumulator tank 144. A manual drain valve 145 is provided on accumulator tank 144 for draining it to the sump 109. The check valve 143 is in series with flow control valve 146. A check valve 147 across valve 146 enables the pump 106 to change the accumulator tank 144, when valve 146 is closed.

When a prescribed operating pressure is in line 138, the hydraulic fluid from line 142 is bypassed by a relief valve 148, via line 137, which returns the hydraulic fluid to a low pressure return line 149. The hydraulic fluid in the return line 149 thence travels through a cooling coil 150 where a fan 151 cools the hydraulic fluid and through a filter 152, back into the sump 109. The actuation of fan motor 151*a* of fan 150 is controlled by a thermostat 153 in the sump 149 so as to cool coil 150 when the temperature of the hydraulic fluid in the sump 109 is elevated above a prescribed temperature. A low level alarm 154 is also provided on the sump 109 to indicate when hydraulic fluid is needed for the system.

Connected to line 138 between the check valve 143 and the flow control valve 146 is high pressure hydraulic fluid line 155. This high pressure line 155 leads to a directional valve 156 which controls the opening and closing of the grapple 99. When the directional valve 156 is in one position, hydraulic fluid is supplied to a piston (not shown) to open the grapple 99 and when it is in the other position, hydraulic fluid is supplied to the piston (not shown) to close the grapple 99. A gauge 157 indicates the pressure in the line 142. A return line 156 receives the fluid from the piston (not shown) which controls the grapple 99. Solenoid 54 controls valve 156, as will be explained hereinafter.

The pump 105 also takes a suction from the sump 109 via the filter 140 and valve 141 and discharges to line 160 which leads to a directional control valve 161. The directional control valve 161, in turn, supplies high pressure hydraulic fluid selectively to either line 162 or line 163. When high pressure fluid is supplied to line 162, it is fed to one side of both wheel motors 36 so as to drive the carriage 20 of the crane in one direction along track 35 and when fluid is fed via line 163 to wheel motors 36 it will drive the motors 36 in the other direction. The return of the hydraulic fluid from the line 162 or 163, which acting as a return line i.e., the line which is not supplied with high pressure fluid, is via valve 161 and 164 to the low pressure line 159. Leakage of the motors 36 is feed through return line 165 to the sump 109. A relief valve 166 connected between the line 160 and line 164 provides for relief of excessively high pressure in line 160. Control valve 137 controls the position of valve 161. The pressure to actuate control valve 137 is from the low pressure line 111, via line 134, filter 135 and line 136. A relief valve 136*a* returns fluid to sump 109 when excessive pressure is in line 136. Valve 137 is controlled by potentiometer P2, via solenoid S3.

In a cushion valve 169 are relief valves 170 and 171 which shunt the fluid from the high pressure side to the low pressure side if any excessively high pressure is developed in the line 162 or 163, the excess fluid traveling through the check valves 172.

Also in cushion are the check valves of 173 and 174 respectively, the function of which is to prevent the return of fluid to the lines 162 and 163 except through the relief valve 172 of cushion valve 169.

ELECTRICAL SYSTEM

Referring specifically to FIG. 6 it will be seen that the electrical control system includes certain elements which are located in a control console 200. Other components are located on the crane, itself. Thus, FIG. 6 is divided by a vertical broken line 201 for the purpose of indicating which of the electrical elements are located in the control console 200 and which of the electrical elements are located on the crane, itself.

In more detail, a 480 volt, 3 phase, a.c. current is supplied from a source of current or supply panel denoted by numeral 202, through a main supply or disconnect switch Sw1 to wires 203. Wire 204 is a ground wire leading from the ground G of panel 202 through one set of the slip rings 14 and brushes 15 to a neutral or ground G1 on the crane. In like fashion, the wires 203 are connected respectively to slip rings 14 and the current, thus supplied, is taken off of the slip rings 14 by the brushes 15, the brushes 15 being connected respectively to wires 205 which lead to one side of an overload breaker or switch Sw2. Both switch Sw1 and Sw2 are manually operated switches, switch Sw2 being the breaker on the crane which can open to disconnect all current.

From the switch Sw2, wires 199 lead to a terminal block 206 and thence to wires 207. Two of the wires 207 lead to the terminals of a manually operated heater switch Sw3 which when closed supplies current through wires 208 and through relay switches RS1 to an oil heater 209 which is disposed in the sump tank 109.

Connected respectively to the wires 207 are wires 210 which, in turn, are connected to relay switches RS2. When these relay switches RS2 are closed, current is supplied via the motor heaters 211 to motor 101. Current is simultaneously supplied, through wires 212 and fuse 213, to the primary coil of transformer T1, the secondary of which is connected to a solenoid S1 connected to the winch brake safety valve 133 which controls the brake 121.

Hence, when the motor 101 is energized, the solenoid S1 is also energized so as to move valve 133 to a position to return hydraulic fluid through line 134 and 132 to the pumps 103 and 104 as the brake 121 is held open. When however, the motor is de-energized, solenoid S1 releases the spring loaded valve 133 so as to permit it to drain the line 132 to the sump 109.

Also connected to the wires 207 through a relay switches Sw4 is the fan or cooler motor 151*a*, the current being supplied through relay switches RS3 and through motor heaters 215. The motor 151*a* drives the fan 151 for cooling the return hydraulic fluid in coil 150.

The electrical control current for the functions of the crane is supplied from two of the wires 207 through wires 216 to the primary of a transformer T2. Fuses 217 are in series with the primary of transformer T2. One side of the secondary of transformer T2 is grounded to neutral G1 on the crane body and to a ground wire 220. A hot wire or bus 221 leads from the secondary through a fuse 222 to a supply wire or hot bus 223 and thence through its associated brushes 15 and slip ring 14, to wire 224 at the console 200. Wire 224 connects to one terminal of a power control normally opened switch Sw5. The other terminal of switch Sw5 leads through wire 225 to the terminal of a normally closed emergency stop switch Sw6. The other terminal of the switch Sw6 connects to a bus 226.

Across the bus 226 to ground wire 220 are the various electrical elements including a pump start switch Sw7 which is connected in series via wire 227, its slip ring 14 and brush 15 and wire 228, to relay coil RC2 and a normally closed overload switch OL1. An indicator light or lamp 230 from wire 227 to a ground wire 231 indicates when the switch Sw7 is closed. One end of ground wire 231 is connected through a slip ring 14 and brush 15 via wire 232, to the ground wire 220. When the switch Sw7 is depressed, current is supplied to the lamp or light 230 and is also supplied to the coil RC2 so as to close the relay switches RS2 and start the motor 101, provided switches Sw1 and Sw2 are manually closed. Hence, motor 101 can be started and stopped from console 200 or from the crane, as desired.

In the console 200 the end of the ground wire 231 is connected to one side of the primary of a transformer T3, the other side of which is connected to the hot wire 226. The secondary of the transformer T3 is connected to a full wave rectifier R1. The rectifier R1 supplies 24 volts of d.c. current to the wires 232 and 233, the wire 233 being a negative wire and the wire 232 being the positive wire. The negative wire 233 is connected to one side of the winch control potentiometer P1 and to one side of wheel control potentiometer P2, the potentiometers being located at the control console 200. The function of potentiometer P1, as pointed out above, is to control the up and down movement of the grapple 99 and the function of potentiometer P2 is to control the left and right movement of the base 20.

The positive wire 232 is connected to the other side of the potentiometers P1 and P2 respectively while the center tap of the potentiometer P1 is connected via wire 234 through slip ring 14 and brush 15 to wire 235. The center tap of the potentiometer P2 is connected by wire 236 through one of the slip rings 14 and brushes 15 to a wire 237. The arm of potentiometer P1 is connected via wire 238 to one of the slip rings 14 and brushes 15 to wire 239 and the arm of potentiometer P2 is connected via wire 240 and one of the slip rings 14 and brushes 15 to wire 241. The wire 235 leads to one side of a solenoid S2 which controls the raising and lowering of the grapple 99 through control of the fluid flow of pump 103. The wire 239 is connected, through a normally open relay switch RS4 and its parallel diode 242, to the other side of the solenoid S2. Wire 237 is connected to one side of a swing proportional, valve controlled, solenoid S3 while wire 241 is connected to the other side of this solenoid S3. By manipulation of the arm of the potentiometer P1, the solenoid S2 is supplied with current which is positive on one side or negative on one side, as desired. This controls the movement of the solenoid S2. In like fashion, the potentiometer P2 controls the movement of solenoid S3.

A resistance heater 218 for heating the slip ring housing 16 to prevent icing is provided across the wires 223 and 220. Also, an electrical resistance heater 219 which is in series with a thermostatic switch of a thermostat 219*a* is likewise connected across the wires 220 and 223. The thermostat 219*a* and the heater 219 are located in the control enclosure of the crane so that the hydraulic equipment and the electrical equipment do not freeze.

From the hot wire 223 leads a hot wire 223*a* which terminates at the terminals of fan motor control switch Sw8 and Sw9 of the thermostat 153. The other terminals of the switches Sw8 and Sw9 respectively lead to the oil cooling fan relay coils RC3 and the oil heater relay coil RC1. With a high temperature detected by the thermostat 153, the switch Sw8 will be closed so as to actuate the motor 151*a* by the closing of all switches RS3. Of course, when the temperature drops, switch Sw8 will be opened, thereby dropping out the relay and opening the relay switches RS3. The coil RC3 is in series with a normally closed overload switch OL2, to ground wire 220 and hence, if there is an overload on the motor 151*a*, the switch OL2 will cause the coil of relay RC3 to drop out. The oil heater switch Sw9 is closed, in the event that a low temperature is detected by the thermostat 153, in which case current is supplied to relay coil RC1 to close the relay switches RS1 and thereby energize the oil heater 209. Of course, when the hydraulic fluid is heated to a normal temperature, the switch Sw9 will open and drop out the relay by de-energizing the coil RC1 and hence open the switches RS1.

In series across wires 220 and 224 are a pair of normally closed limit switches LS1 and LS2 in series with the host travel limit relay coil RC4. When the crane is operative, switch LS1, which is located on the boom will be closed, except when the grapple 99 is in a fully up position, at which time the limit switch LS1 will be opened thereby de-energizing the relay coil RC4.

Switch Sw4 in the grapple control circuit is operated from the coil RC4 and, therefore, will be opened so that no current will be supplied by wire 239 to the solenoid S2 for the purpose of moving the grapple 99 up or down. The second limit switch LS2 is adjacent to the drum or spool 88 of the winch 87 so that it is actuated when a prescribed amount of cable 86 has been taken up on the drum 88. It too will stop winch 87 by dropping out the relay through de-energizing of relay coil RC4 to open switch RS4.

Leading from the hot wire 226 are a plurality of wires 250, 251, 252, 253 and 254. The wire 250 leads to one terminal of a normally open, grapple close switch Sw10, the other terminal of which is connected by wire 255 and through the slip ring 14 and a brush 15 to wire 256. The wire 256 leads to one terminal of a solenoid S4 and from the other terminal to ground wire 220.

The solenoid S4 controls the open and close directional valve 156 for the grapple 99. When the coil S4 is energized fluid is supplied to close the grapple 99, via valve 156. When it is de-energized, the valve 156 returns to its original position by spring action so as to permit the grapple 99 to open.

The wires 251, 252 lead to the terminals of a single pole, single throw, switch Sw11, the other terminals of which are connected, via wires 257 and 258 through appropriate slip rings and brushes 14 and 15, to wires 259 and 260. The wire 259 is connected through a solenoid S5 to ground wire 200 and the wire 260 is connected through solenoid S6 to ground wire 220. Solenoids S5 and S6 are located on the grapple 99 for rotating the grapple 99 in one direction or the other.

Switch Sw11 can be manipulated so as to selectively close either of the switch arms, while the other is opened. Thus, when switch Sw11 is manipulated to close the circuit to solenoid S5, the grapple will be rotated to the left. By the same token, when the lower switch of switch Sw11 is closed, and the upper switch opened, a circuit is made to solenoid S6 so as to rotate the grapple to the right.

If desired, mechanisms can be provided to cause the grapple 99 to travel outwardly or inwardly. The wiring for such an arrangement includes wire 253 which leads to switch Sw12 and from Sw12 through the slip ring 14 and brush 15 to wire 262. Wire 262 leads through solenoid coil S7 to ground. Wire 254 is connected to the other switch element of switch Sw12 and leads thence through a slip ring 14 and brush 15 to wire 263. The wire 263 supplies current through the solenoid coil S8 to ground wire 220. When switch Sw12 is manipulated to close the upper switch element thereof, the solenoid S7 is energized so as to cause a motor (not shown) to move the grapple 99 outwardly on the tip section 51. The closing of the lower switch element of switch Sw12 energizes the solenoid S8 to cause the motor (not shown) to move the grapple 99 inwardly.

For controlling the movement an opening and closing of the grapple 99 from the crane, itself, crane switches Sw14, Sw15, and double pole single throw switch Sw16 are provided, the one terminal of each being connected as shown in FIG. 6 to hot wire 251 and the other terminal of the switch Sw14 being connected to wire 256. The other terminal of switch Sw15 is connected to wire 259. With respect to switch Sw16, one terminal of one pole is connected to wire 262 and the other terminal of the other pole to wire 263. The manipulation of switch Sw14 will operate the grapple 99 in the same way as the actuation of Sw10. The actuation of switch Sw15 will manipulate the grapple 99 in the same manner as the actuation of switch Sw11 and the actuation of switch Sw16 will manipulate the grapple in the same manner as described for switch Sw12.

Connected to the hot wire 251 and through wire 264 to wire 228 is a pump start crane switch Sw17. When switch Sw17 is depressed, the switch Sw7 is bypassed so as to energize the relay coil RC2 and thereby close the relay switches RS2 to energize the motor 101. Coil RC2 is provided with a hold down circuit so that once either switch Sw7 or Sw17 is closed momentarily, the relay coil RC2 will remain energized unless there is a overload which opens the overload switch OL1. This hold down circuit includes a normally closed switch Sw18 in series with a normally opened relay switch **R2*a*. The switch Sw18 is connected via wire 270 and its slip ring 14 and brush 15 to hot wire 226 while switch R2*a* is connected to wire 264. Thus, the energizing of relay coil of RC2 will close switch R2*a* and since switch Sw18 is normally closed, current will be supplied from hot wire 226 via wire 270 and wire 264 to wire 228 and thence to the relay coil RC2. Of course, when it is desired to shut down the motor 101, either switch Sw18 can be manually opened on the crane or switch Sw6 can be manually opened at the control console 200. The manually opening of switch Sw6 de-energizes the hot wire 226 and hence, interrupts current to all of the relay coils RC1, RC2, RC3 and the solenoids S2, S3, S5, S5, S6, S7 and S8**.

OPERATION

It will be understood that the crane of the present invention is used primarily for loading logs, denoted generally by the numeral 300 onto a live deck 301 for processing by a pulp mill. For this purpose, it is necessary to lay the logs on the live deck parallel to each other. Hence, in the construction of the crane, the live deck 301 is disposed along a center line CL which is along the usual axis of the grapple 99. The control console 200 is usually located at a position adjacent to the live deck 301 so that an operator can watch the operation of the crane from a remote position. Also, the operator can observe the crane grapple 99 as it places the logs on the live deck 301. The switch Sw1 is normally left in a closed position so that current is normally supplied to the crane. Furthermore, when it is desired to operate any component of the crane, the main switch Sw2 is closed so as to supply current to the controls of both the motor 101. In addition, if it is necessary to heat the oil, switch Sw3 is closed. Thereafter, the thermostat 153 determines that the oil is too cold, it will close the switch Sw9 thereby energizing relay coil RC1 and closing relay switch RS1. As soon as the oil has been heated up, however, switch Sw9 will open and thereby break the circuit to the coil RC1 which in turn releases the switches RS1 to open. If the temperature of the oil is too high, switch Sw8 will be closed to energize relay coil RC3 to close the relay switch RS3 and operate the fan 151 for cooling the hydraulic fluid passing through the cooling coils 150.

When it is desired to pick up one of the logs 300 or several of the logs 300, as the case may be, the switch SW5 is closed to thereby supply electricity to the controls via normally closed switch Sw6. This renders the wire 226 hot. Therefore, switch Sw7, when closed momentarily, provides a circuit for energizing relay coil RC2 which, once energized, remains in an energized condition and is held down by the hold down circuit including the switch **RS2*a* and the switch SW18. Thus, so long as the coil RC2 is energized, the lamp or light 230 is also energized as a visual indication of the fact that the relay coil RC2 is holding in the relay switch RS2 to operate the motor 101**.

The mechanism is now fully operative. Under normal operating conditions, the crane would then be rotated by use of potentiometer P2 to a prescribed position on the track 35 so that the grapple 99 would be over the selected group of logs 300. The grapple 99 lowered in an open position, then closed on a log and the grapple 99 raised. Potentiometer P1 controls the raising and lowering, and switch Sw10 the opening and closing of grapple 99. Next the crane would be rotated to position the grapple 99 over the live deck 31 and the grapple 99 lowered and opened to release the log.

It will be understood by those skilled in the art that many variations may be made in the embodiment here chosen for the purpose of illustrating the invention without departing from the scope thereof as defined by the appended claims.

I claim:

1. A crane comprising:

(a) a body having a carriage;

(b) said carriage having a vertical axis, said carriage being rotatably supported for pivoting about said vertical axis;

(c) a circular continuous rail extending around said vertical axis below said carriage; the center of the circle of said rail coinciding with said vertical axis; said carriage extending in opposite directions from said center outwardly and over circumferentially spaced portions of said rail for providing one end portion of said carriage over one portion of said rail and the other end of said carriage over the other portion of said rail;

(d) circumferentially spaced wheels rotatably mounted on said carriage at said other end portion for rotation about substantially horizontal radial axes, said wheels riding on said rail;

(e) an additional wheel means at said one end portion about substantially a horizontal radial axis, said additional wheel riding on said rail;

(f) said body including an open frame dog leg truss assembly having a base section extending upwardly and forwardly from said carriage, said base section having a proximal end pivotally secured to said one end portion of said carriage and an upper end outwardly of said rail, said truss assembly having a generally horizontal boom section secured by one end to and extending outwardly from said upper end, the outer end of said boom section forming the distal end of said truss assembly;

(g) sheave means at the distal end of said truss assembly;

(h) a cable winch means at said other end portion of said carriage;

(i) cable means extending from the winch means upwardly and over said carriage and thence through said truss assembly adjacent to the distal end of said base section and thereafter through said horizontal section and over said sheave means;

(j) a grapple on the end portion of said cable means below said distal end;

(k) counterweight means over the end portion of said rail adjacent to said winch;

(l) flexible cables connected adjacent to said counterweight and said winch and to said truss assembly adjacent to the junction of said base section and said horizontal section for supporting said truss assembly from pivoting outwardly; and (m) pivot means between said carriage and said proximal end of said base section providing the pivotal securement therebetween.

2. The crane defined in claim 1 wherein said carriage includes a pair of forwardly straight diverging beams, means for joining the forward end portions of said beams together to form triangular frame, means joining the rear end portions of said beams together, beam means joining said central portion of said carriage to said diverging beams, and, journal means extending downwardly from said carriage adjacent the corners formed by the end portions of said beams for carrying said spaced wheels.

3. The crane defined in claim 2 including rearwardly and upwardly extending struts secured by the forward ends to said carriage adjacent the forward ends of said beams, upstanding bars connected between the end portions of said struts and the rear end portion of said carriage for forming with said diverging beams a pair of vertically disposed triangular frames.

4. The crane defined in claim 1 wherein said carriage includes a pair of forwardly diverging beams and a cross bar extending between the forward end portions of said diverging beams, and wherein said pivot means includes spaced pivot pins being carried adjacent to the forward end portions of said beams.

5. A crane comprising:

(a) a body having a carriage;

(b) an upstanding stationary post having a vertical axis, said carriage being rotatably secured by its central portion to said post for pivoting about said vertical axis;

(c) a circular continuous rail extending around said post below said carriage; the center of the circle of said rail coinciding with said vertical axis of said post; said carriage extending in opposite directions from said center outwardly and over circumferentially spaced portions of said rail for providing one end portion of said carriage over one portion of said rail and the other end of said carriage over the other portion of said rail;

(d) circumferentially spaced wheels rotatably mounted on said carriage at said other end portion for rotation about substantially horizontal radial axes, said wheels riding on said rail;

(e) an additional wheel means at said one end portion about substantially a horizontal radial axis, said additional wheel riding on said rail;

(f) said body including an open frame truss assembly extending upwardly and forwardly from said carriage, said assembly having a proximal end secured to said base said one end portion of said carriage and a distal end outwardly of said rail;

(g) sheave means at the distal end of said truss assembly;

(h) a cable winch on said carriage;

(i) cable means extending from the winch through said truss assembly and over said sheave means;

(j) a grapple on the end portion of said cable means below said distal end; and (k) counterweight means over the end portion of said rail;

(l) said truss assembly being L-shaped and having an upwardly and outwardly inclined base section connected by one end to said carriage and a generally horizontally extending boom section connected by its inner end to the forward outer end of said base section outwardly of said rail;

(m) said sheave means being mounted at the outer end portion of said boom section, and including pivot means for pivotally securing the inner end of the base section of said truss assembly to said carriage and flexible cable means extending from the outer end of said base section downwardly and rearwardly toward said counterweight to the rear portion of said carriage for supporting said truss assembly in its upwardly and forwardly extending position; and (n) rearwardly and upwardly extending struts connected respectively by their forward ends to said pivot pins, the rear end portions of said struts terminating above the rear end portion of said carriage, upstanding bars extending between said carriage and said rear end portions of said struts and pivot pins extending between the end portions of said bars and the end portions of said struts for pivotally joining the same together.

6. The crane defined in claim 5 wherein said cable means are connected to the pivot pins joining the ends of the struts and end of said bars together.

7. The crane defined in claim 6 wherein said counterweight is disposed adjacent to said bars and including struts embedded in said counterweight and connected to said pivot pins which join said struts and said bars.

8. The crane defined in claim 7 wherein said cable winch is mounted adjacent to said counterweight and spaced above said carriage.

9. The crane defined in claim 1 including a hydraulic pump carried on said carriage, a hydraulic motor driving said winch and control means remote from said carriage for controlling the delivery of hydraulic fluid from said pump means to said motor means.

10. The crane defined in claim 1 including a hydraulic sump, a pump connected to said sump for supplying hydraulic fluid from said sump, a hydraulic motor connected to said winch, hydraulic lines connecting said pump to said motor, electric control means for controlling the delivery of hydraulic fluid by said pump to said motor, and brake means on said motor for arresting the rotation of said winch when said motor is inoperative.

11. The crane defined in claim 10 including hydraulic motor means for driving said wheels and electric control means for controlling the rotation of said motor means.

12. A crane comprising:

(a) a horizontally disposed carriage having forward and rear end portions;

(b) a horizontal circular continuous race below said carriage;

(c) pivot means in the center defined by said circular race, said pivot means being provided with a vertical axis and pivotally receiving the central portion of said carriage, said end portion of said carriage extending in opposite directions from said central portion of said carriage, said carriage being rotatable about said vertical axis;

(d) wheel means mounted to said end portions of said carriage for engaging said race at circumferentially spaced locations;

(e) a frame truss assembly carried by said carriage, said frame assembly being mounted by chordially spaced lower ends to said forward end portion of said carriage and protruding in a radial direction upwardly and outwardly from said forward end portion, certain of said wheel means being mounted respectively below said lower ends;

(f) flexible tension means extending over said carriage inwardly and downwardly in an essentially straight path from an intermediate upper portion of said frame truss assembly to said rear portion of said carriage for arresting outward movement of said frame assembly;

(g) grapple means carried by the outer end portion of said frame assembly;

(h) grapple actuating means carried on the rear end portion of said carriage for manipulating said grapple, said grapple actuating means including a cable extending from said upper portion of said frame truss assembly in an essentially unobstructed path inwardly an downwardly over said carriage and adjacent to said tension means from said intermediate upper portion of said truss assembly to said rear portion of said carriage; and (i) motor means for said certain of said wheel means for selectively rotating said wheel means in one direction and in the other, for pivoting said carriage about said vertical axis in one direction and in the other.

13. The crane defined in claim 12 wherein said carriage is triangular, two corner portions of the triangular carriage forming said forward portion of said carriage; and wherein the lower end of said frame truss assembly includes spaced legs secured respectively to said corner portions of said carriage.

14. The crane defined in claim 13 wherein said wheel means which is mounted to said forward portion of said carriage includes a pair of spaced wheels, each of which is driven by said motor means.

15. The crane defined in claim 14 wherein said spaced wheels are respectively below said legs of said frame truss assembly.

16. The crane defined in claim 15 wherein said tension means includes flexible cables and wherein said ends of said frame truss assembly are pivotally connected to the forward corner portions of said carriage.

17. The crane defined in claim 16 including a counterweight mounted on said rear portion of said carriage over the wheel means which is mounted on said rear portion.

18. The crane defined in claim 17 wherein said race is a track and said wheels means are flanged wheels riding on said track.

19. A crane comprising:

(a) a horizontally disposed carriage having forward and rear end portions;

(b) a horizontal circular continuous race below said carriage;

(c) pivot means in the center defined by said circular race, said pivot means being provided with a vertical axis and pivotally receiving the central portion of said carriage, said end portion of said carriage extending in opposite directions from said central portion of said carriage, said carriage being rotatable about said vertical axis;

(d) wheel means mounted to said end portions of said carriage for engaging said race at circumferentially spaced locations;

(e) a frame truss assembly carried by said carriage, said frame assembly being mounted by chordially spaced lower ends to said forward end portion of said carriage and protruding in a radial direction upwardly and outwardly from said forward end portion, certain of said wheel means being mounted respectively below said lower ends;

(f) tension means extending from an intermediate upper portion of said frame truss assembly to said rear portion of said carriage for arresting outward movement of said frame assembly;

(g) grapple means carried by the outer end portion of said frame assembly;

(h) grapple actuating means carried on the rear end portion of said carriage for manipulating said grapple; and (i) motor means for said certain of said wheel means for selectively rotating said wheel means in one direction and in the other, for pivoting said carriage about said vertical axis in one direction and in the other;

(j) said carriage being triangular, two corner portions of the triangular carriage forming said forward portion of said carriage;

(k) the lower end of said frame truss assembly including spaced legs secured respectively to said corner portions of said carriage;

(l) said wheel means which is mounted to said forward portion of said carriage including a pair of spaced wheels, each of which is driven by said motor means;

(m) said spaced wheels being respectively below said legs of said frame truss assembly;

(n) said tension means including flexible cables;

(o) said ends of said frame truss assembly being pivotally connected to the forward corner portions of said carriage;

(p) a counterweight mounted on said rear portion of said carriage over the wheel means which is mounted on said rear portion;

(q) said race being a track and said wheel means being flanged wheels riding on said track; and a pair of upstanding bars mounted by their lower ends to said rear portion of said carriage, and a pair of upwardly and rearwardly extending compression struts, the forward ends of said compression struts being pivotally connected to said legs of said frame truss assembly and the rear ends of said compression struts being connected to the upper ends of said bars.

20. The crane defined in claim 19 wherein said counterweight is outwardly of said bars on said carriage.

21. The crane defined in claim 20 including tension struts extending through said counterweight and pivot pins securing the upper ends of said bars, the upper ends of said compression struts, the upper ends of said tension struts and the lower ends of said cables, together.

22. The crane defined in claim 14 including a platform on the rear portion of said carriage, an electric motor on said platform, pump means on said platform driven by said electric motor; said grapple actuating means including a hydraulic motor connected hydraulically to said pump means, a winch driven by said hydraulic motor, and said cable connected between said winch and said grapple means.

23. The crane defined in claim 22 including motor means connected to said wheel means for driving the same selectively in one direction or the other, said motor means being connected to and actuated by said pump means.

24. The crane defined in claim 22 including a sump on said carriage adjacent to and communicating with said pump means for storing and supplying hydraulic fluid to said pump means.

25. The crane defined in claim 22 including electrical control means for said pump means, said electrical control means being remote from said carriage, and electrical wiring including ring and brush means on said pivot means for connecting said electrical control means to said pump means.

* * * * *